United States Patent [19]

Gregory

[11] Patent Number: 4,502,463

[45] Date of Patent: Mar. 5, 1985

[54] METHOD AND APPARATUS FOR EFFICIENTLY CAPTURING AND DISTRIBUTING HEAT PRODUCED BY GAS LOGS

[76] Inventor: Willis H. Gregory, Rte. 2, Angier, N.C. 27501

[21] Appl. No.: 604,173

[22] Filed: Apr. 26, 1984

[51] Int. Cl.[3] ..... F24B 7/00

[52] U.S. Cl. ..... 126/121; 126/127

[58] Field of Search ..... 126/120, 121, 123, 127, 126/131, 137, 110 B; 165/124; 237/51

[56] References Cited

U.S. PATENT DOCUMENTS

| | | | |
|---|---|---|---|
| 1,621,135 | 3/1927 | Sala | 126/121 |
| 1,653,466 | 12/1927 | Nickels | 126/121 |
| 1,703,459 | 2/1929 | Sala | 126/121 |
| 1,867,740 | 7/1932 | Guy | 126/121 |
| 2,348,127 | 5/1944 | Grimes | 126/110 B |
| 2,787,997 | 4/1957 | Asbury | 126/121 |
| 3,324,938 | 6/1967 | Berkoff | 126/110 B X |
| 3,976,047 | 8/1976 | Breen et al. | 126/121 |
| 4,174,700 | 11/1979 | Bartsch | 126/121 |
| 4,188,939 | 2/1980 | Gamso et al. | 126/121 |
| 4,280,474 | 7/1981 | Ruegg | 126/121 |
| 4,390,005 | 6/1983 | Porter | 126/110 B |
| 4,458,666 | 7/1984 | Osada | 126/110 B |

FOREIGN PATENT DOCUMENTS

| | | | |
|---|---|---|---|
| 48059 | 8/1917 | Sweden | 126/121 |
| 155187 | 12/1920 | United Kingdom | 126/131 |

OTHER PUBLICATIONS

Woodstove Fireplace and Equipment Directory, vol. III, 1980, p. 170.

*Primary Examiner*—Margaret A. Focarino
*Attorney, Agent, or Firm*—B. B. Olive

[57] ABSTRACT

The present invention relates to an improved method and apparatus for efficiently capturing heat generated by gas logs and distributing the heat produced thereby into selected areas of a structure. In a fireplace environment having gas logs therein, the present invention entails a duct structure extending generally over the gas logs. A fan is provided adjacent the back wall and floor of the fireplace communicating with an inlet end of the duct structure. The fan produces a system of forced air which is introduced into the duct structure and moved therethrough. As the system of forced air passes through the duct structure it is heated by the gas logs underlying the duct structure, and the heated forced air is then exhausted from the duct into an adjoining structure.

7 Claims, 4 Drawing Figures

METHOD AND APPARATUS FOR EFFICIENTLY CAPTURING AND DISTRIBUTING HEAT PRODUCED BY GAS LOGS

DESCRIPTION

1. Technical Field

The present invention relates to heat exchanger devices and devices used in fireplaces for efficiently capturing and distributing heat produced from a fuel source burned within said fireplace and more particularly to a method and apparatus of this character adapted to be used in conjunction with gas logs for capturing heat produced thereby and effectively and efficiently distributing this heat within a structure to heat the same.

2. Background Art

In recent years, the popularity and commercial success of solid fuel burning stoves, fireplace inserts, furnaces and the like has been quite substantial. Many factors have contributed to this commercial success and acceptance. Perhaps foremost has been the ever increasing cost of conventional forms of energy used in heating, that is petroleum fuels and electricity. Secondly, stoves and fireplace inserts have been greatly improved in design from an energy viewpoint compared to pre-existing stoves and fireplace inserts. Stoves and fireplace inserts commercially available today are very efficient, and are in fact designed such that the heat output can be easily controlled. Thirdly, many people have ready access to wood, and even if they do not, wood can be purchased at a competitive price with respect to conventional forms of energy.

Aside from stoves and fireplace inserts, fireplaces continue to be very popular among people, especially because of the aesthetic value received therefrom. The use of heat exchangers within the fireplace has greatly increased the efficiency of what used to be a very poor and inefficient approach to heating.

To gain the aesthetic values of a fireplace, but yet not be bothered with the trouble and inconvenience of maintaining a wood fire, many people have chosen to use gas logs within their fireplace. For the most part, this gives the desired aesthetic value. But as with conventional fireplaces, the heating is very inefficient. In the case of gas logs, the heat produced from the gas logs tends to remain static and stationary about the fireplace, and does not tend to move in such a way as to evenly distribute the heat within the structure.

My U.S. Pat. No. 4,432,337 is directed to a heat exchanger adapted to be utilized in connection with gas logs. The apparatus and method described and claimed therein have proved to be very efficient in capturing and distributing heat produced by gas logs. However, it has been found that in some circumstances objectionable fumes may be introduced into the associated structure or room by the system shown in my patent. My new system is intended to overcome any and all deficiencies or limitations of my prior system. The prior art references cited in my U.S. Pat. No. 4,432,337 are incorporated by reference herein.

Also as additional prior art to be noted, applicant is informed that a heater fan and duct apparatus is presently manufactured under the trademark ALADDIN (Model HF 183) by Alladin Energy Products, Inc., of Nashville, Tenn., for use with kerosene heaters. However, it is neither adapted for nor intended to be utilized in conjunction with fireplace gas logs. The unit is secured to a kerosene heater so that a horizontal duct portion is centered over the burner chimney with the blower outlet facing forward so as to more efficiently capture heat produced by a free-standing, portable kerosene heater.

Therefore, there is a need for a still further improved system that is designed and adapted to be used in connection with gas logs in a fireplace for more efficiently capturing and distributing the heat produced thereby within an associated structure such as the den or living room of a house without introducing any objectionable fumes into same.

DISCLOSURE OF INVENTION

The present invention entails a method and apparatus for efficiently capturing heat produced by gas logs within a fireplace and distributing that heat, in a forced air manner, throughout an associated structure. To accomplish this, the present invention provides an apparatus that includes a duct structure that extends generally over a gas log set. Provided with the duct structure is an electrically powered fan assembly positioned generally rearward of the gas logs forward of the fireplace backwall and adjacent the fireplace floor for generating a system of air that is directed into and through the duct structure. The duct structure is designed to be positioned within the relatively warm or hot air overlying and surrounding the gas logs so that the system of air being directed therethrough forms a system of heated air that is exhausted from the duct into an adjoining room or rooms or otherwise directed to an area of the structure for distribution.

It is therefore an object of the present invention to provide a method and apparatus for use in conjunction with gas logs for efficiently capturing heat produced thereby and distributing the same to heat a structure.

A further object of the present invention resides in the provision of an apparatus adapted and designed to be situated within a fireplace for effectively capturing heat produced by a gas log set and efficiently distributing the heat into the structure housing the fireplace.

Still a further object of the present invention resides in the provision of a method and apparatus for capturing and distributing heat produced by a gas log set wherein a system of air is generated from within the fireplace and adjacent the floor thereof and directed through an exchanger assembly surrounding the gas log set so as to heat the generated air which is then exhausted from the exchanger to provide heating for the structure.

A further object of the present invention resides in the provision of an apparatus or heat exchanger device of the character referred to above that is relatively simple in design, easy to manufacture, reliable, and very efficient in capturing and distributing heat produced by the gas log set.

It is also an object of the present invention to provide an improved method and apparatus for capturing and distributing heat produced by a gas log set wherein there is no fluid communication between the hot air overlying the gas logs and the generated air as it passes through the heat exchanger device.

Other objects and advantages of the present invention will become apparent from a study of the following description and the accompanying drawings which are merely illustrative of the present invention.

BEST MODE FOR CARRYING OUT THE INVENTION

With further reference to the drawings, the apparatus of the present invention is shown therein and indicated generally by the numeral 10. Apparatus 10 is in the form of a heat exchanger device as the same is designed to be utilized in conjunction with a gas log set where the heat exchanger device acts to efficiently capture heat produced by the gas logs and to distribute the same within a structure for heating the same.

Figure 3:
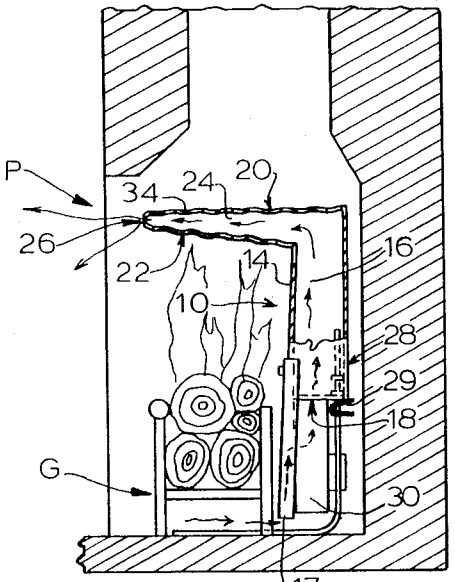
FIG. 3 is a side sectional view of a fireplace having a gas log set disposed therein with the apparatus or heat exchanger device according to the present invention disposed within said fireplace adjacent said gas log set for capturing and distributing the heat thereof.
Figure 2:
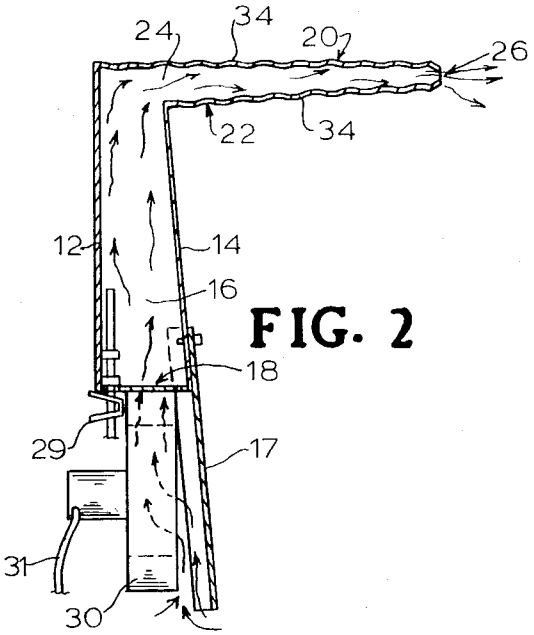
FIG. 2 is a fragmentary sectional view taken substantially along line 2—2 of FIG. 1.
Figure 4:
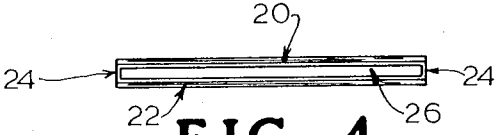
FIG. 4 is an enlarged front elevational view taken in the direction of line 4—4 of FIG. 1.
Figure 1:
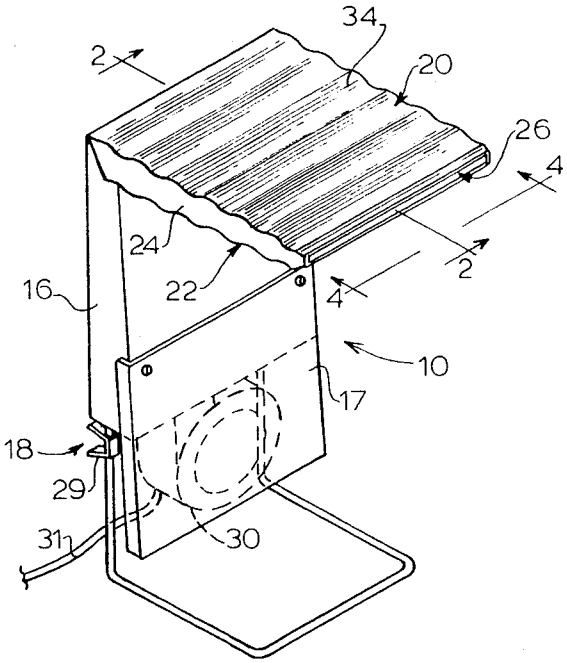
FIG. 1 is a perspective view of the apparatus or heat exchanger device according to the present invention.

Viewing the apparatus 10 in more detail, it is seen that the same is adapted to set within a fireplace P and to extend and generally overlie the source of heat within the fireplace which in the present disclosure entails a gas log set G (FIG. 3) having a suitable valve controlled gas supply which is not shown.

Heat exchanger device 10 comprises a basic L-shape duct structure formed of thin, highly heat conductive metal, e.g. thin thirty-two gauge aluminum sheet, and having black surfaces to enahance heat absorption from the gas log set G. Forming a part of the L-shaped duct structure is a vertical leg section that includes a back 12, front 14, and a pair of sides 16 which are fabricated together to form an enclosed duct section. Depending downwardly from front 14 is a shield plate 17 which usefully provides heat shielding for later mentioned fan assembly 30. Defined by the lower portion of the vertical leg is an inlet end 18.

Continuing to refer to the L-shaped duct structure forming a part of heat exchanger 10, it is seen that the same includes a horizontal duct section extending from the vertical leg section, with the horizontal section extending generally over and above the flames produced by gas log set G. Both the vertical leg section and horizontal section of the L-shaped duct structure are formed so as to have a progressively diminishing cross sectional area beginning at inlet end 18. Viewing the horizontal section of FIG. 2, it is seen that the same includes a generally rectangular cross sectional assembly comprising a top wall 20, a bottom wall 22, and a pair of joining sides 24. It is noted that the horizontal section just referred to is communicatively connected to the vertical leg section such that air entering inlet end 18 may be forced through the vertical leg and horizontal duct sections while gaining velocity due to the aforementioned diminishing cross sectional area thereof and where the same air may exit out an exhaust end 26 defined by the horizontal duct section just described. The exhuast end 26 is preferably formed with a reduced size opening by tapering top wall 20 downwardly and bottom wall 22 upwardly, as shown in FIGS. 1–4, so as to further increase the velocity of the heated air flow exhausting therefrom in order to more effectively distribute the heat into the structure housing the fireplace.

Operatively connected in fluidly sealed engagement to inlet end 18 is an electrically powered fan assembly 30 having a power cord 31. Fan assembly 30 in the case of the embodiment illustrated herein is of the squirrel cage type, but it is to be understood that other fan designs could be utilized. Fan 30, as will be subsequently appreciated, is designed to generate a system of forced air that enters fan 30 from behind shield 17 (FIG. 2), contact therewith providing an initial pre-heating of the air while cooling shield 17, and moves from inlet end 18 through the vertical leg and then dog legs into the above described horizontal section where the air is exhausted from exhaust end 26 thereof. Fan 30 is positioned between the backwall of the fireplace P and the gas logs G and is protected from heat damage by the laterally spaced gas logs G by the aforementioned shield 17. Heat conductive shield 17 transmits a portion of the heat received thereby to the attached L-shaped duct structure.

Heat exchanger device 10 is designed to effectively capture heat from the gas log set G and to efficiently distribute air heated thereby within the structure housing the fireplace and gas log set. As will be more fully appreciated from subsequent portions of this disclosure, the generated system of air resulting from the operation of fan 30 is heated by the relatively warm or hot air surrounding the gas log set G and is exhausted out exhaust end 26 for purposes of heating.

In accomplishing this, bottom 22 and top 20 of the horizontal duct section may be provided with corrugations 34 (FIGS. 1–3) extending generally perpendicular to the direction of air flow so as to facilitate better heat transfer to the air flow passing through the horizontal duct system and which is then exhausted out the exhaust end 26 of the horizontal section. It should be understood, however, that the aforementioned corrugations 34 may also be provided so as to extend in the airflow direction or the horizontal duct section may be constructed of flat sheet metal without any corrugations therein. The combination of the progressively diminishing cross sectional area, the corrugations and the restricted opening 26 enhance the heat transfer.

Heat exchanger device 10 also includes an adjustable leg support structure 28. Adjustable leg support structure 28 is designed such that the heat exchanger device 10 can be adjusted, utilizing clip 29, with respect to the fireplace P and/or the gas log set G to efficiently position the same for the most efficient operation. Fireplace P as illustrated typically includes spaced-apart side walls, a back wall, a floor and a flue. The heat is typically at least partially exhausted through the flue.

It is appreciated from the foregoing specification that the present invention presents a relatively simple and improved apparatus or heat exchanger device that is designed to efficiently capture heat resulting from a gas log set and to distribute the heat within an adjacent room or rooms or otherwise as selected throughout the structure. The device of the present invention utilizes an efficient and unique approach to generate an air flow from relatively cool air within and adjacent the floor of the fireplace and to heat the air flowing therethrough and to efficiently discharge the heated air from the apparatus into the structure for heating the same. Since the heated air flowing through the device is not co-mingled with heated air produced by the gas logs G there are not any undesirable fumes produced thereby.

The present invention, of course, may be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A method for capturing heat produced by gas logs located within and spaced forwardly of the back wall of a fireplace having spaced-apart side walls, said back wall, a floor and a flue, said heat normally being at least partially exhausted from the fireplace through the flue, comprising the steps of:

(a) positioning electrically-powered air fan means in said fireplace between the gas logs and said fireplace back wall;

(b) operating said air fan means so as to pull air into said fan and to create an airflow from air proximate to said floor which has not been substantially heated by the gas logs;

(c) directing the airflow into the inlet end of a single enclosed sheet metal formed duct means having no flow obstruction therein and at least a portion that extends generally horizontally over the gas logs within said fireplace so as to heat the airflow through the duct means and a communicating vertical portion between said gas logs and back wall;

(d) preventing any fluid communication between hot air rising from the gas logs and the heated airflow being directed through said duct means;

(e) exhausting the heated airflow from the outlet end of said duct means into an ambient environment outside said fireplace so as to elevate the temperature thereof;

(f) supporting said fan means on said vertical portion and in a manner wherein said fan means are heat shielded from said gas logs; and (g) supporting said vertical portion on said floor with adjustable support means whereby to position said fan means and inlet end immediately above said floor.

2. A method for capturing heat produced by gas logs within a fireplace as claimed in claim 1 including the step of providing said enclosed duct means with progressively diminishing cross-sectional area in the airflow direction, a black surface and corrugations extending generally perpendicular to the airflow along at least a portion of the length of said duct means in order to enhance heat transfer.

3. In combination with a fireplace having spaced-apart side walls, a back wall, a floor and a flue, gas logs operatively positioned in said fireplace forward of said back wall, an apparatus for capturing heat produced by said gas logs and also positioned in said fireplace generally rearwardly and above said gas logs, said apparatus comprising:

(a) a single sheet metal formed duct means enclosed along the length thereof, having no flow obstruction therein and having an inlet end and an exhaust end, a vertical portion between said gas logs and back wall and a horizontal portion extending generally over said gas logs;

(b) electrically-powered fan means supported on said vertical portion within said fireplace adjacent the floor thereof between said gas logs and the back wall of said fireplace said fan means being heat shelded from said gas logs and operatively associated with said duct means for generating a system of air and directing same into the inlet end of said duct means and causing it to move through said duct means and out the exhaust end thereof into a surrounding area about said fireplace; and (c) support means adjustably mounted on said vertical portion and adapted to rest on said floor to support said inlet end and fan means above said floor;

whereby said system of air is heated during its passage from the inlet end through said enclosed duct means and out the exhaust end thereof.

4. The combination as claimed in claim 3 wherein said duct means have a progressively diminishing cross-sectional area in the air passage direction and is constructed of thin aluminum sheet metal having corrugations therein extending generally transverse to air passage along at least a portion of the length thereof to facilitate heat transfer.

5. The combination as claimed in claim 3 wherein:

(a) said duct means is a progressively diminishing cross-sectional area in the air passage direction and is constructed of thin sheet metal; and (b) wherein said fan means heat shielding comprises mounts a heat shield formed of sheet metal below said inlet and between said fan means and gas logs.

6. The combination as claimed in claim 5 wherein said fan means is adapted to generate said system of air by pulling in air between said heat shield and fan means and forcing such air into said duct means inlet end.

7. A heating apparatus for a fireplace having spaced-apart side walls, a back wall, a floor, and a flue, comprising:

(a) gas logs operatively positioned in said fireplace between said sidewalls, forward of said back wall, above said floor and below said flue;

(b) integrally-formed single duct means formed of sheet metal and enclosed along the length thereof and having inlet and exhaust ends with no flow obstruction therein, a horizontal portion extending generally over said gas logs and of progressively diminishing cross-sectional area in the air passage direction and a vertical portion positioned below said horizontal portion and between said gas logs and back wall;

(c) electrically-powered fan means positioned within said fireplace and supported by said duct means vertical portion in a position above said floor, adjacent said duct means inlet end and between said gas logs and back wall, said fan means being heat shielded from said gas logs and being operative for generating a system of air and directing same into the inlet end of said duct means and causing it to move through said duct means and out said exhaust end into a surrounding area about said fireplace; and (d) adjustable support means mounted on said duct means vertical portion for adjustably supporting said duct means on and above said floor.

* * * * *

UNITED STATES PATENT AND TRADEMARK OFFICE

CERTIFICATE OF CORRECTION

PATENT NO. : 4,502,463

DATED : March 5, 1985

INVENTOR(S) : Willis H. Gregory

It is certified that error appears in the above—identified patent and that said Letters Patent is hereby corrected as shown below:

Col. 6, line 24, "a" should be --of--.

Col. 6, line 28, delete "mounts".

Signed and Sealed this

*Twenty-fifth* Day of *June 1985*

[SEAL]

*Attest:*

DONALD J. QUIGG

*Attesting Officer* *Acting Commissioner of Patents and Trademarks*

Disclaimer and Dedication 4,502,463.—*Willis H. Gregory,* Angier, N.C. METHOD AND APPARATUS FOR EFFICIENTLY CAPTURING AND DISTRIBUTING HEAT PRODUCED BY GAS LOGS. Patent dated Mar. 5, 1985. Disclaimer and dedication filed Apr. 22, 1985, by the inventor.

Hereby disclaims and dedicates to the public the entire term of said patent.

[*Official Gazette July 23, 1985.*]